US010058149B1

(12) United States Patent
Wittenberg et al.

(10) Patent No.: US 10,058,149 B1
(45) **Date of Patent: *Aug. 28, 2018**

(54) ATTACHMENT MECHANISM ARCHITECTURES FOR A WATCH BAND

(71) Applicant: Apple Inc., Cupertino, CA (US)

(72) Inventors: Michael B. Wittenberg, San Francisco, CA (US); Benjamin J. Kallman, Cupertino, CA (US); Ryan C. Perkins, San Francisco, CA (US); Tatsuya Sano, San Jose, CA (US); Zhipeng Zhang, Santa Clara, CA (US); Richard H. Koch, Cupertino, CA (US); Jeffrey C. Olson, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,026

(22) Filed: Sep. 18, 2017

Related U.S. Application Data

(60) Provisional application No. 62/397,754, filed on Sep. 21, 2016.

(51) Int. Cl.
*G04B 37/00* (2006.01)
*A44C 5/20* (2006.01)
*H01R 11/30* (2006.01)

(52) U.S. Cl.
CPC ..... *A44C 5/2057* (2013.01); *H01R 11/30* (2013.01); *H01R 2201/00* (2013.01)

(58) Field of Classification Search
CPC .. A44C 5/2057; H01R 11/30; H01R 2201/00; H01R 13/6205; A41D 1/005; H01H 13/639; G04G 17/06; G04G 21/00; G04G 47/00; G04G 21/04; G04G 15/006
USPC ..... 368/282, 10, 204, 281, 37; 439/345, 660
See application file for complete search history.

(56) References Cited

U.S. PATENT DOCUMENTS

| | | | | |
|---|---|---|---|---|
| 8,976,628 | B2 * | 3/2015 | Leoni | G04G 21/00 368/10 |
| 9,274,506 | B2 * | 3/2016 | Lu | G04G 17/02 |
| 9,445,633 | B2 * | 9/2016 | Tulloch | H01R 31/06 |
| 2004/0084200 | A1 * | 5/2004 | Noirjean | A44C 5/14 174/50 |
| 2006/0140055 | A1 * | 6/2006 | Ehrsam | A44C 5/18 368/10 |
| 2007/0064542 | A1 * | 3/2007 | Fukushima | G04B 37/1486 368/282 |

* cited by examiner

*Primary Examiner* — Edwin A. Leon
(74) *Attorney, Agent, or Firm* — McDermott Will & Emery LLP

(57) ABSTRACT

A watch band can provide both a physical connection and an electrical connection with a watch body of a watch. The watch band is fixed relative to the watch body and an electrical connection is either performed either simultaneously or shortly thereafter. The electrical connection enables data and power transfer between the watch body and the watch band. The electrical connection can also be performed by a secondary user interaction. Secondary user inactions can involve the user sliding, pulling, pushing, or rotating a portion of the watch band or watch body.

20 Claims, 13 Drawing Sheets

ATTACHMENT MECHANISM ARCHITECTURES FOR A WATCH BAND

CROSS-REFERENCE TO RELATED APPLICATIONS

This application claims the benefit of U.S. Provisional Application No. 62/397,754, entitled "ATTACHMENT MECHANISM ARCHITECTURES FOR A WATCH BAND," filed Sep. 21, 2016, the entirety of which is incorporated herein by reference.

TECHNICAL FIELD

The present description relates generally to a wearable device, and, more particularly, to physical and electrical connections of a watch band to a watch body of the wearable device, such as a wristwatch or other wrist-mounted device (e.g., a smartwatch).

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device to the user can depend on the function and arrangement of the watchband.

In one example, wristwatches typically include a case and a band. The case carries the components or mechanisms of the wristwatch including the face. The band extends away from the case so that it can wrap around the wrist of a user. The band may be integral with the case. However, in most cases, the band is a separate part that is attached to the case.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
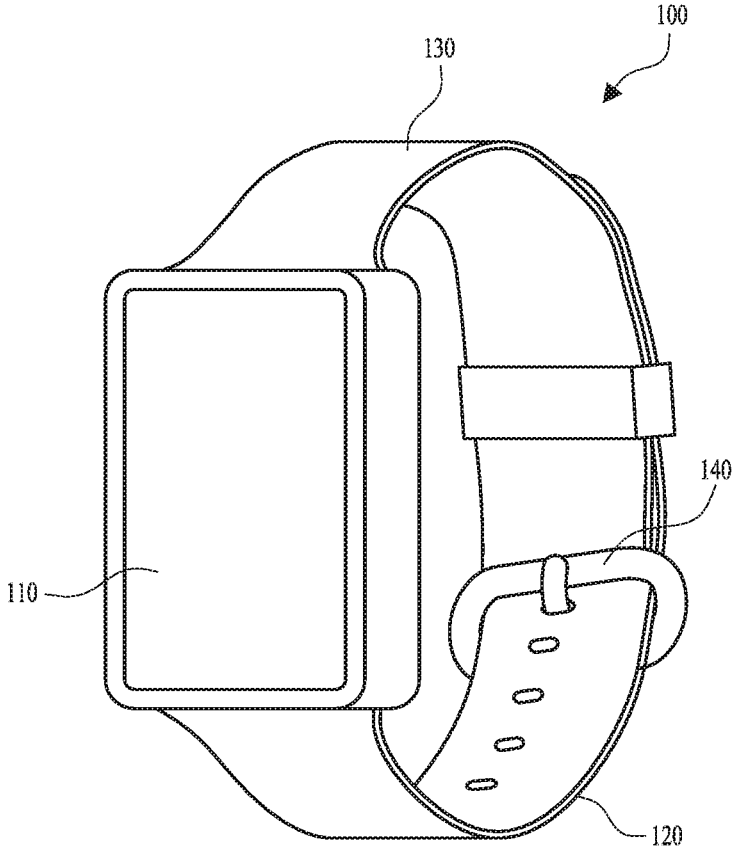
FIG. 1 shows a front perspective view of a watch with a watch band.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Smartwatches include a watch band to attach a watch body of the smartwatch to a user's wrist. To increase the functionality of the watch, independently of changing the watch body, watch bands as described herein can be used to provide additional features to the smartwatch, or to extend features of the watch body. For example, batteries, memory, processors, sensors, and additional electrical components can be integrated into the watch band to augment the user's experience. Accordingly, to provide interoperability between the watch body and features of the watch band, the watch band can do more than merely physically connect to the watch body, but can also electrically connect to the watch body in order to transfer data and power between the watch body and components of the watch band.

The following disclosure relates to mechanisms for establishing a physical connection and an electrical connection between a watch band and a watch body of a wearable device (e.g., a smartwatch). The physical connection of the watch band to the watch body can be established first to help fix the watch band relative to the watch body. The physical connection itself may not establish an electrical connection between the watch band and the watch body but can fix and lock the watch band relative to the watch body. The electrical connection can be separately established to enable data and power transfer between the watch body and the watch band. While the electrical connection can also involve physical contact between the watch body and the watch band, the purpose of the electrical connection is to establish data and power transfer between the watch body and the watch band, and in some examples not to fix or lock the watch band to the watch body.

The transfer of data and/or power between the watch band and the watch body can be performed in a number of different ways, for example, such as conductively, inductively, optically, or by any other suitable transmission mode. Establishing the physical connection between the watch body and the watch band first can help protect and align the subsequent electrical connection, especially where it includes precision electrical components, such as small-scale pin connectors (e.g., pogo pins).

The physical connection between the watch band and the watch body can be established in a number of different ways. For example, the physical connection can be established by sliding a proximal end of the watch band into a slot of the watch body. As the watch band slides into the slot of the watch body, the watch band can reach a predetermined position and a locking mechanism can lock the watch band in place. The locking mechanism physically fixes the watch band relative to the watch body and does not release the watch band from the watch body until the user disconnects the locking mechanism. After the watch band is fixed relative to the watch body, an electrical connection can be established.

The electrical connection between the watch band and the watch body can be established at a number of different times, but in some examples not before the physical connection. For example, the electrical connection can be established simultaneously with the physical connection between the watch band and the watch body. Alternatively or additionally, the electrical connection can be automatically established immediately after the physical connection is established. Alternatively or additionally, the electrical connection can be established upon a secondary user interaction after the physical connection is established. Examples of secondary user interactions can include, for example, sliding, pulling, pushing, or rotating a portion of the watch band or watch body.

Once the electrical connection is established, the watch band can include a lock-out feature that prevents disconnection of the physical connection between the watch band and the watch body until after the electrical connection is disconnected. By preventing the user from sliding the watch band in the slot before the electrical connection is disconnected, precision electrical components, such as small-scale pogo pins, can be protected.

When the user desires to swap out watch bands, the user can first disconnect the electrical connection, which disables the lock-out feature. The electrical disconnection can be automatic or user controlled. Once the lock-out feature is disabled, the user can then disconnect the physical connection to be able to slide the watch band out from the watch body.

The present disclosure details attachment mechanism architectures for a watch band that include connections between a watch body and the watch band, where the connection includes both a physical, non-conductive connection and a separate electrical connection. The physical connection fixes and locks the watch band in place relative to the watch body. The electrical connection establishes a connection between the watch body and the watch band to enable data and power transfer. While the electrical connection can also include physical contact between components of the watch body and the watch band, the purpose of the electrical connection is to enable data and power transfer. Different architectures are described herein that establish the physical connection and the electrical connection between the watch band and the watch body.

In some embodiments, the physical connection between the watch body and the watch band occurs before the electrical connection between the watch body and the watch band. For example, the user can slide the watch band into a slot of the watch body and fix the watch band relative to the watch body. After the watch band is fixed relative to the watch body and locked into place, an electrical connection between the watch body and the watch band can be established. The electrical connection can involve a secondary user interaction to establish the electrical connection. For example, establishing the electrical connection between the watch body and the watch band can involve the user performing a secondary action after the physical connection is established, such as, for example, sliding, pulling, pushing, or rotating a portion of the watch band or watch body.

In some embodiments, the physical connection between the watch body and the watch band cannot be disconnected before the electrical connection between the watch band and the watch body is disconnected. The user will need to disconnect the electrical connection before the user will be able to disconnect the physical connection. Disconnecting the electrical connection first can help protect precision electrical components, such as small-scale pogo pins used to establish the electrical connection, during disconnection of the physical connection.

These and other embodiments are discussed below with reference to the figures. However, those skilled in the art will readily appreciate that the detailed description given herein with respect to these figures is for explanatory purposes only and should not be construed as limiting. Also, any feature described with respect to an individual embodiment can be applied to the other described embodiments to the extent it is not inconsistent or otherwise conflicting with the features of the other embodiments.

FIG. 1 illustrates a wearable device 100 that attaches to a user's wrist or other suitable appendage. Wearable device 100 can be, for example, a wrist-worn watch. Alternatively or additionally, the electronic device can be a portable computing device. Examples include cell phones, smart phones, tablet computers, laptop computers, timekeeping devices, computerized glasses and other wearable devices navigation devices, sports devices, accessory devices, health-monitoring devices, medical devices, wristbands, bracelets, jewelry, and/or the like.

Wearable device 100 can include a watch body 110 and a watch band 120 with a first band portion 130, a second band portion 140, and a watch band fastener 150. Watch band 120 couples to watch body 110 on opposing sides of watch body 110. First band portion 130 and second band portion 140 can physically and electrically connect to watch body. The physical and electrical connections can be separate. The physical connection fixes watch band 120 relative to watch body 110. The electrical connection enables data and/or power transfer between watch body 110 and watch band 120. Watch band 120 can secure watch body 110 to the user's wrist by fastening first band portion 130 to second band portion 140 with watch band fastener 150. Watch band fastener 150 can fasten first band portion 130 to second band portion 140 in a number of ways, for example, such as mechanical interlocks, magnets, buckles, latches, hinges, snaps, hook-and-loop fasteners, or any other suitable attachment mechanism.

Figure 2:
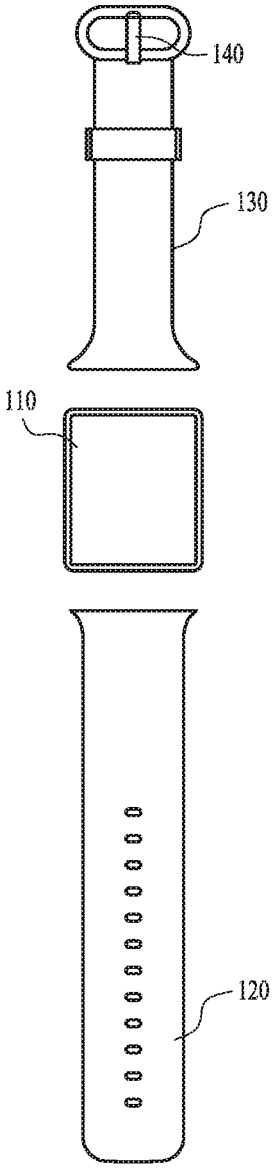
FIG. 2 shows a front view of a watch with a watch band.

FIG. 2 illustrates a view of wearable device 100 with first band portion 130 and second band portion 140 separated from watch body 110. First band portion 130 and second band portion 140 are removably attachable to watch body 110 to enable the user to swap out watch band 120 in order to suit the user's preferences. For example, watch band 120 can be swapped out based on style, color, attachment mechanism, and function of watch band 120.

Figure 4:
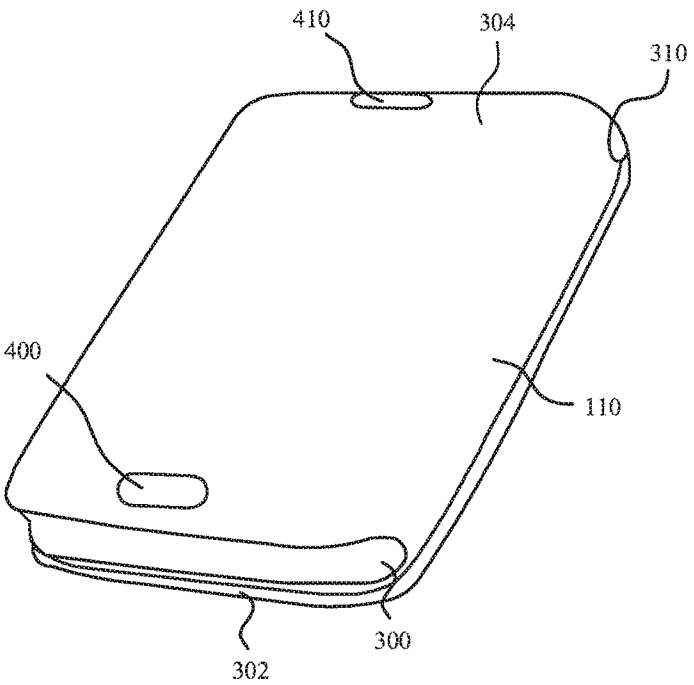
FIG. 4 shows a rear perspective view of the watch body of FIG. 3.
Figure 3:
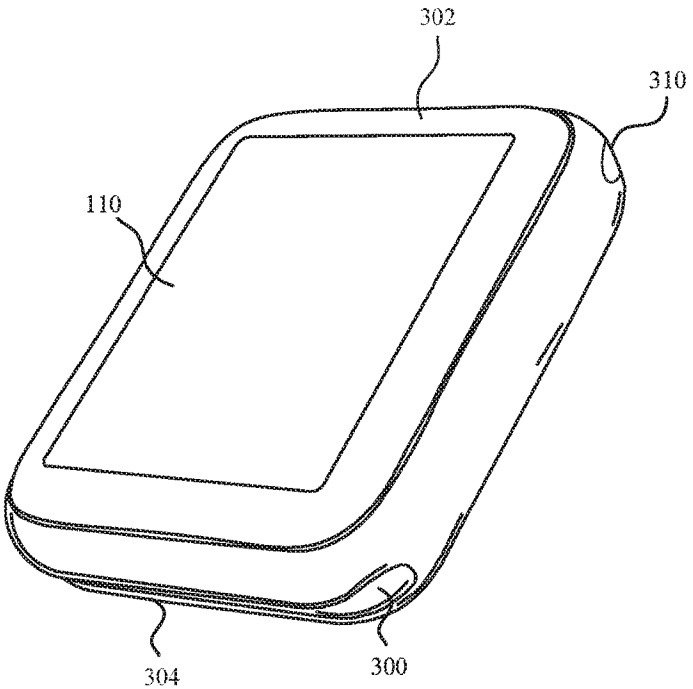
FIG. 3 shows a front perspective view of a watch body.

FIG. 3 illustrates a top perspective view of watch body 110 and FIG. 4 illustrates a bottom perspective view of watch body 110. Watch body 110 can include slots 300 and 310 for attaching first band portion 130 to watch body 110 and second band portion 140 to watch body 110. First band portion 130 can slide into slot 300 and second band portion can slide into slot 310. Slots 300 and 310 can be located at a bottom side 304 and a top side 302 of watch body 110, respectively.

As shown in FIG. 4, watch body 110 can include release buttons 400 and 410. Release buttons 400 and 410 each relate to corresponding slots 300 and 310. Release buttons 400 and 410 can release watch band 120 from slots 300 and 310 (e.g., by releasing a locking mechanism). When the user presses release button 400 or 410, watch band 120 can be released from the locking mechanism, and the user is able to slide watch band 120 out of respective slots 300 and 310.

Figure 5:
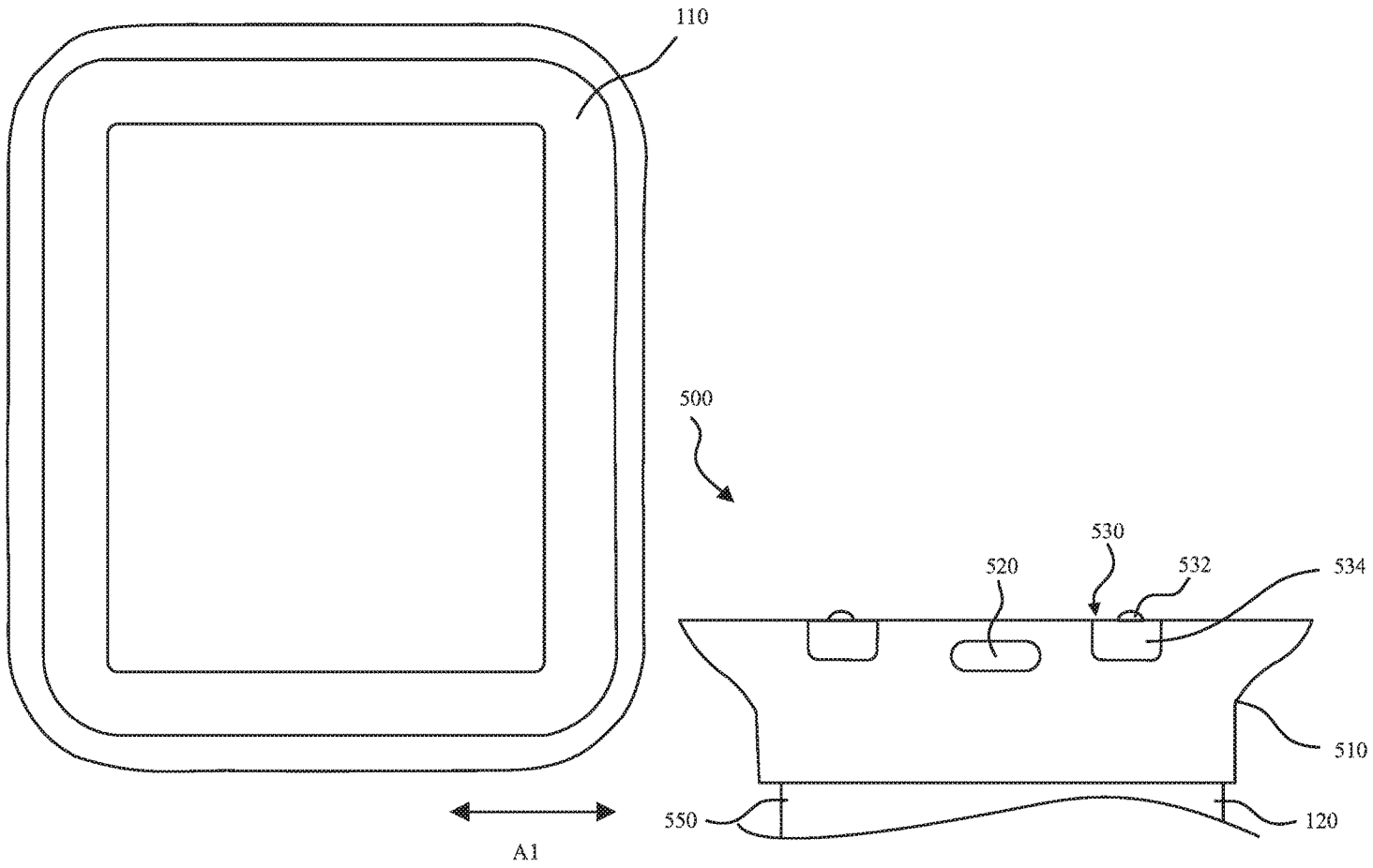
FIG. 5 shows a front view of a watch body and a watch band connector in a disengaged position.
Figure 6:
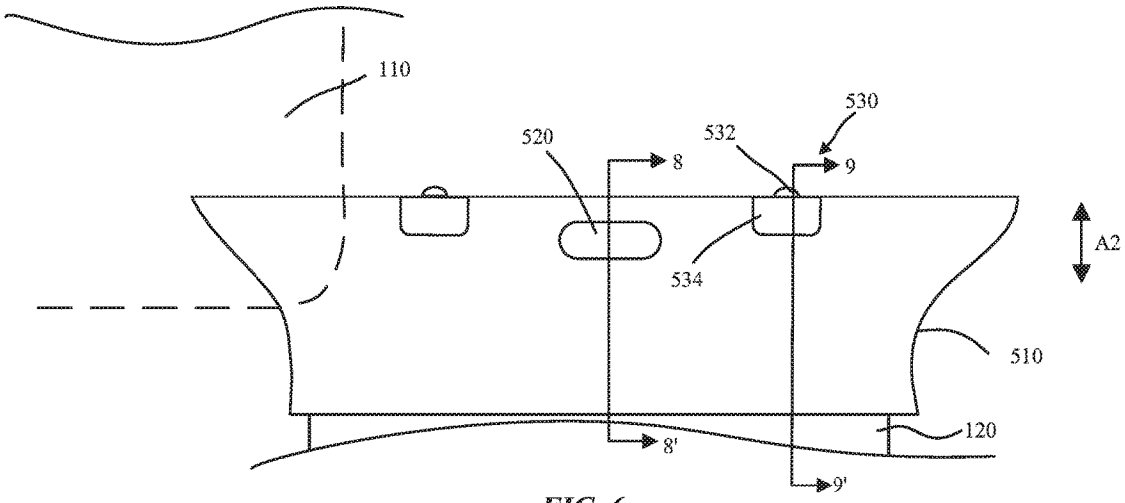
FIG. 6 shows a front view of the watch body and the watch band connector of FIG. 5 in a partially engaged position.
Figure 7:
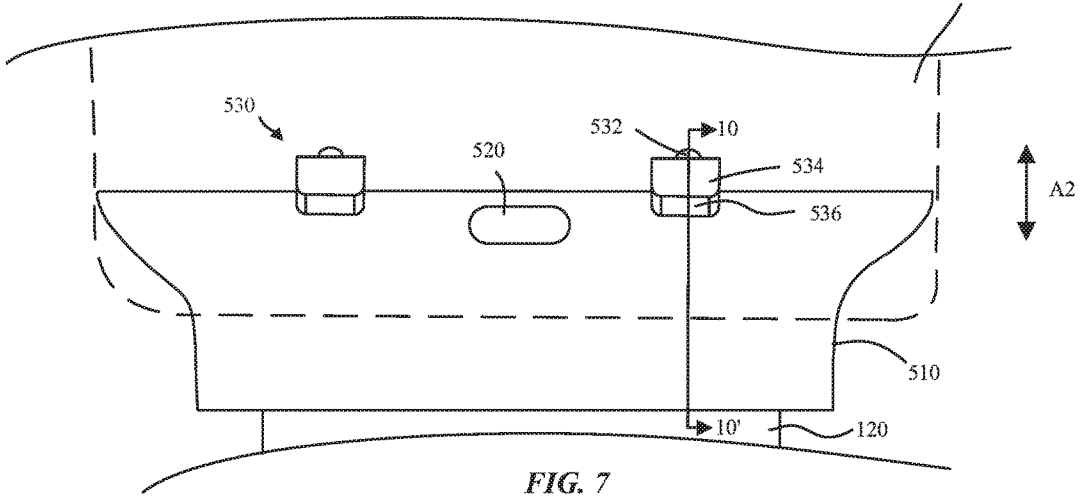
FIG. 7 shows a front view of the watch body and the watch band connector of FIG. 5 in an engaged position.

FIGS. 5-7 illustrate watch body 110 and a watch band connector 500 that can establish a physical connection and an electrical connection between watch body 110 and watch band connector 500. Watch band connector 500 functions as an attachment mechanism to attach watch band 120 to watch body 110. FIG. 5 illustrates watch band connector 500 that can slide into the slot of watch body 110 along a first direction A1, which is illustrated by the arrow. First direction A1 is coincident with the width direction of watch band 120. FIG. 6 illustrates watch band connector 500 in a partially physically engaged position, where watch band connector 500 begins to slide within the slot of watch body 110 (illustrated in broken lines). While partially physically engaged, electrical connectors 530 remain retracted and electrically disengaged. FIG. 7 illustrates watch band connector 500 in a fully engaged position, where watch band connector 500 is fully within the slot of watch body 110. When fully engaged, electrical connectors 530 are extended and electrically engaged with watch body 110 (illustrated in broken lines).

After a physical connection is established (i.e., after watch band connector 500 is physically fixed relative to watch body 110) electrical connectors 530 can be connected to watch body 110. As discussed, FIG. 6 illustrates pogo pins 532 of electrical connectors 530 in an electrically disengaged state (i.e., electrical connectors 530 are not electrically connected with watch body 110), and FIG. 7 illustrates pogo pins 532 of electrical connectors 530 in an engaged state (i.e., pogo pins 532 and seal 534 have moved in a second direction A2 by extension bars 536, which is illustrated by the arrow). Second direction A2 is coincident with the length direction of watch band 120 and perpendicular to first direction A1. Accordingly, after the physical connection between watch band connector 500 and watch body 110 is established, pogo pins 532 of electrical connectors 530 can electrically contact watch body 110 to enable data and power transfer across electrical connectors 530. Seals 534 of each electrical connector 530 help ensure that pogo pins 532 are sealed from external elements, such as, for example, water, air, humidity, or other potentially detrimental environment or detritus. Seals 534 can seal pogo pins 532 by an interference fit between seals 534 and the slot.

Watch band connector 500 can be interchangeably used with either of multiple slots of the watch body 110. Watch band connector 500 can include a connector body 510, a movable lock member 520, and electrical connectors 530. Lock member 520 can be non-conductive and act as an engagement member for physically connecting watch band connector 500 relative to watch body 110. Lock member 520 can be centered in a width direction of watch band connector 500. Each electrical connector 530 can include an electrical connector (e.g., pogo pin 532), a seal 534, and extension bars 536. For simplicity of explanation, electrical connectors can be referred to herein as pogo pins, however one of skill in the art will understand that such pogo pins can be replaced with alternative electrical connectors, such as contact pads or other pin connectors.

While pogo pins 532 are shown in FIG. 5 as projecting out of seal 534, the placement of pogo pins 532 is not so limited. Tips of pogo pins 532 can be in line with tops of seals 534 or in line with the proximal end of watch band connector 500. Pogo pins 532 can also be retracted within seals 534 or lower than a proximal end of watch band connector 500.

The number of electrical connectors 530 can vary depending on the format of data and power transfer between watch band 120 and watch body 110. FIG. 5 illustrates two electrical connectors 530. However, the present disclosure is not so limited and the number of connectors can be two, three, four, or more. Alternatively or additionally, pogo pins 532 and seals 534 can be housed in watch body 110 rather than in watch band connector 500.

Connector body 510 of watch band connector 500 can be integral with the rest of watch band 120. Alternatively or additionally, connector body 510 of watch band connector 500 can be a separate component coupled to a strap portion 550 that forms watch band 120.

Figure 8:
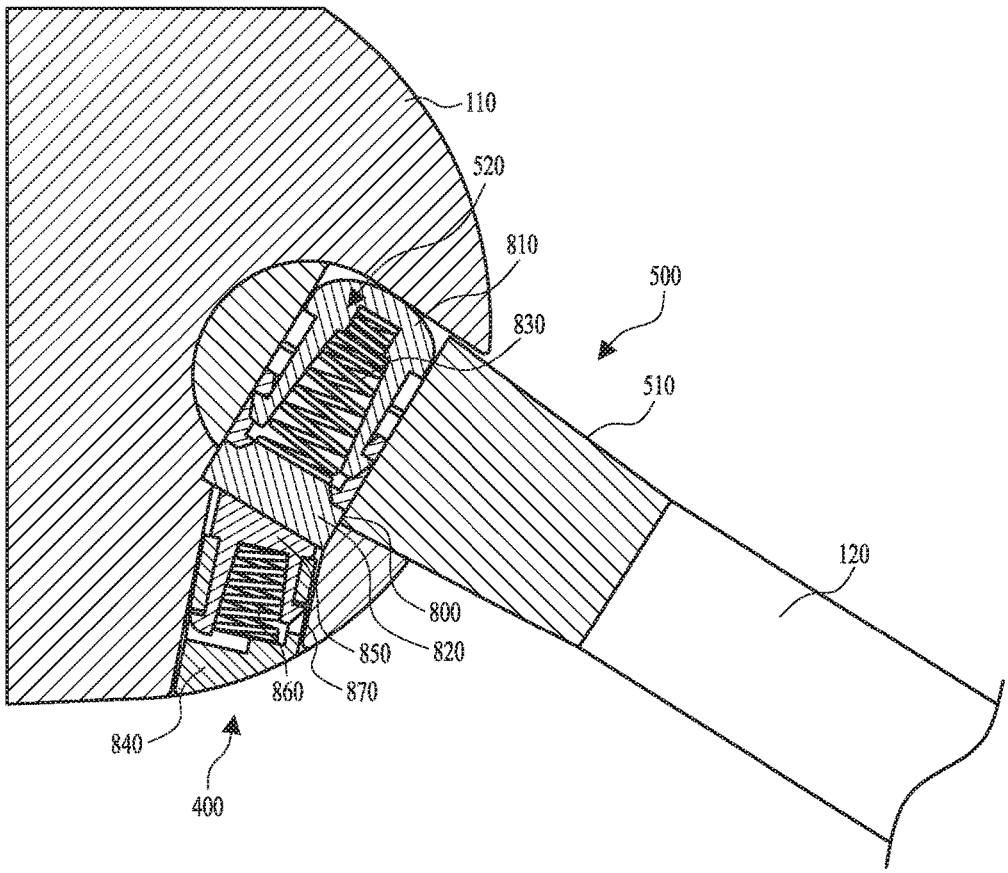
FIG. 8 shows a cross-sectional view of the watch body and the watch band connector taken along line 8-8' of FIG. 6.

Lock member 520 acts as a locking mechanism and helps establish the physical connection between watch band connector 500 and watch body 110. FIG. 8 illustrates a cross-sectional side view of watch band connector 500, lock member 520, and watch body 110 when lock member 520 is physically fixed and locked relative to watch body 110. Lock member 520 can include a ramp 810, a catch member 820, and a spring 830. Ramp 810 can project orthogonally from a surface of watch band connector 500 while catch member 820 can be flush with the opposing outer surface of watch band connector 500 when watch band connector 500 is not inserted into the slot of watch body 110. A cavity or opening 800 can be located in the slot adjacent to catch member 820. Accordingly, when lock member 520 is inserted into the slot, the slot pushes down on ramp 810 of lock member 520, which compresses spring 830. When lock member 520 reaches a predetermined catch position and catch member 820 aligns with opening 800, spring 830 expands and extends catch member 820 into opening 800, as illustrated in FIG. 8.

In order to disengage lock member 520, i.e., remove catch member 820 from opening 800, the user can actuate release buttons 400 or 410. Release buttons 400 and 410 can include a button 840, a plunger 850, and a spring 860, all located within channel 870 of watch body 110. Channel 870 can be interconnected with the slot of watch body 110. The user can actuate button 840 to move button 840 along channel 870. The movement of button 840 along channel 870 can bias spring 860 and engage button 840 with plunger 850. Plunger 850 can engage with catch member 820 and move plunger 850 and catch member 820 along channel 870 which compresses spring 830. Once catch member 820 is flush with opening 800 of the slot, the user can be able to slide watch band connector 500 along the slot in first direction A1.

The physical connection between watch band connector 500 and watch body 110 can be connected in a number of different ways. The physical connection between watch band connector 500 and watch body 110 is also further described in U.S. patent application Ser. Nos. 14/696,406 and 14/789,292, which are hereby incorporated by reference in their entireties.

Figure 9:
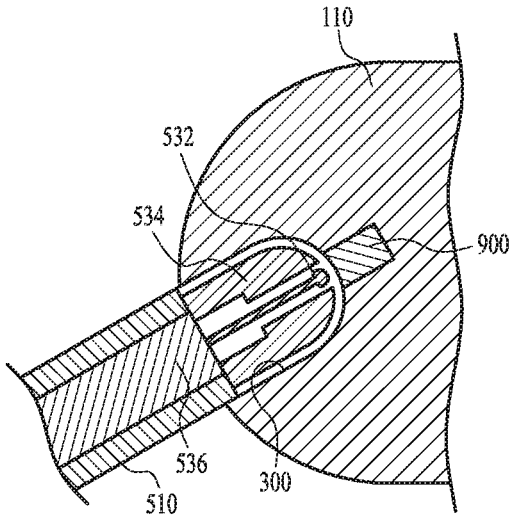
FIG. 9 shows a cross-sectional view of the watch body and the watch band connector taken along line 9-9' of FIG. 6.
Figure 10:
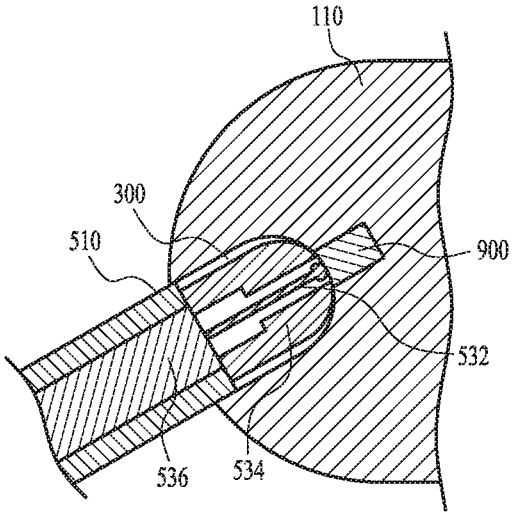
FIG. 10 shows a cross-sectional view of the watch body and the watch band connector taken along line 10-10' of FIG. 7.

FIGS. 9 and 10 illustrate a cross-sectional side view of watch body 110, and watch band connector 500. FIG. 9 illustrates pogo pin 532 in an electrically disengaged state (i.e., pogo pins 532 are not in contact with contact portion 900). FIG. 10 illustrates pogo pin 532 in an electrically engaged state (i.e., pogo pins 532 are in direct contact with contact portion 900 by movement of extension bar 536, establishing an electrical connection between pogo pins 532 and contact portion 900). As discussed previously, the electrical connection can be established automatically after the physical connection is established or the electrical connection can be established by a secondary user interaction to engage pogo pins 532 with contact portion 900.

Figure 11:
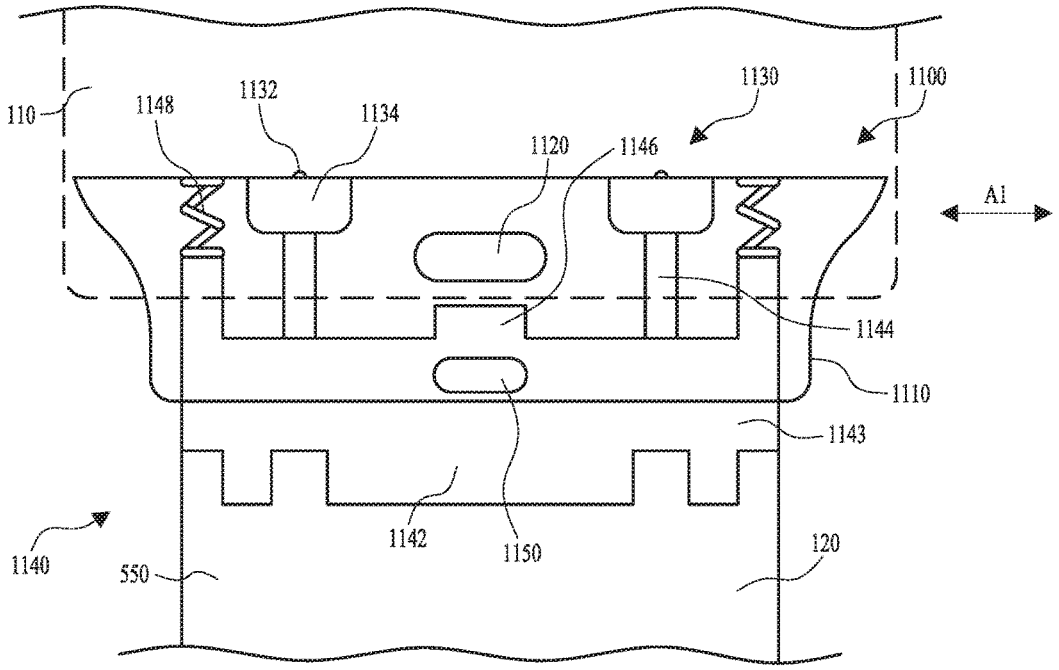
FIG. 11 shows a front schematic view of a watch body and a watch band connector in an electrically disengaged position and a secondary user interaction system in a first position.
Figure 12:
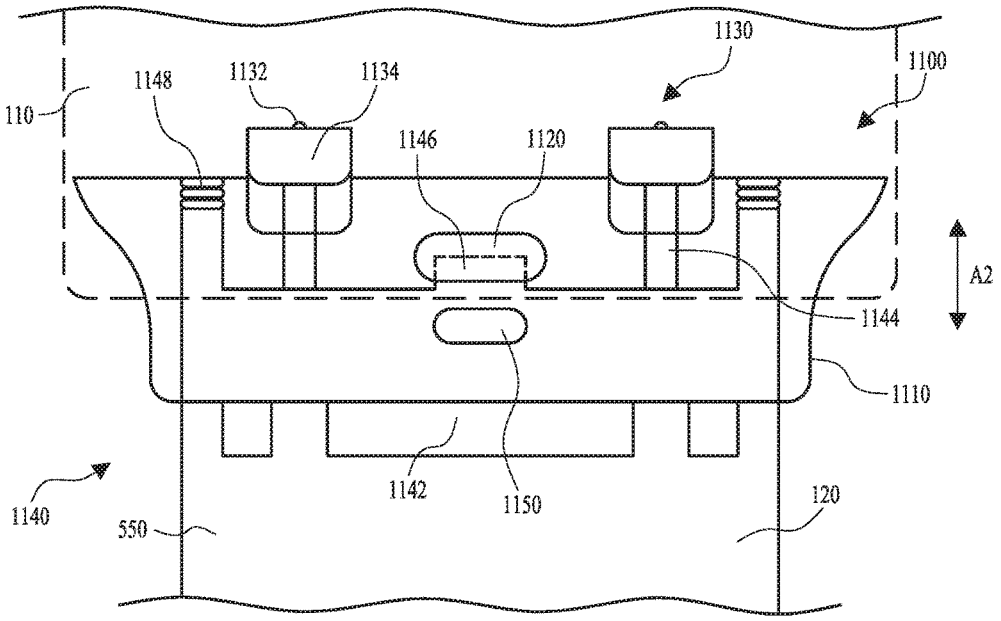
FIG. 12 shows a front schematic view of the watch body and the watch band connector of FIG. 11 in an electrically engaged position and the secondary user interaction system in a second position.

FIGS. 11 and 12 illustrate an exemplary embodiment of an electrical connection between a watch band connector 1100 and watch body 110 that can be established by a secondary user interaction after the physical connection is established.

FIG. 11 illustrates watch band connector 1100 in solid lines, whereas watch body 110 is illustrated in broken lines. Watch band connector 1100 has a connector body 1110, a movable lock member 1120, and electrical connectors 1130. Lock member 1120 can have the same features as lock member 520 described above, including a ramp that projects orthogonally from a surface of watch band connector 1100, a catch member that is flush with the opposing outer surface of watch band connector 1100, and a spring disposed between the ramp and a catch member. Each electrical connector 1130 can include a pogo pin 1132 and a seal 1134. Watch band connector 1100 can be integral with watch band 120 or can be a separate component coupled to strap portion 550 that forms watch band 120.

The user can slide watch band connector 1100 into the slot of watch body 110 along first direction A1 to physically fix watch band connector 1100 relative to watch body 110. Lock member 1120 helps secure the physical connection between watch band connector 1100 and watch body 110. When watch band connector 1100 slides in the slot, the slot pushes against the ramp of lock member 1120, which compresses the spring of lock member 1120 between the ramp and a catch member of lock member 1120. When lock member 1120 reaches a predetermined catch position within the slot, the catch member of lock member 1120 aligns with a corresponding cavity or opening of a similar shape as the catch member of lock member 1120 within the slot of watch body 110. When lock member 1120 reaches the predetermined catch position, the compressed spring extends the catch member of lock member 1120 into an opening located in the slot. Lock member 1120 fixes watch band connector 1100 relative to watch body 110, including limiting the ability of watch band connector 1100 to slide along first direction A1.

Watch band connector 1100 can further include a secondary user interaction system 1140 to establish the electrical connection after the physical connection is established. For example, the user can move or otherwise actuate a portion of watch band connector 1100 to establish the electrical connection (e.g., by sliding, pulling, pushing, or rotating a portion of watch band connector 1100). Secondary user interaction system 1140 can move pogo pins 1132 in second direction A2 to bring pogo pins 1132 into physical contact with respective contact portions.

For example, FIG. 11 illustrates secondary user interaction system 1140 involving the user pushing a portion of watch band 120 into watch band connector 1100 (e.g., pushing strap portion 550, which can include a sled 1142, into watch band connector 1100). Watch band 120 is attached to sled 1142 that is mostly disposed within watch band connector 1100. A portion 1143 of sled 1142 can be exposed outside of watch band connector 1100. Sled 1142 is connected to electrical connectors 1130 by connection links 1144 (which can be rigid bars) and the movement of sled 1142 in second direction A2 moves electrical connectors 1130 an equal amount in second direction A2. When sled 1142 moves in second direction A2, return springs 1148 are compressed, as illustrated in FIG. 12. Sled 1142 can be fabricated from a rigid material to directly translate motion in second direction A2 between watch band 120 and electrical connectors 1130.

FIG. 12 illustrates electrical connectors 1130 in an electrically engaged position. Secondary user interaction system 1140 has been actuated by the user by pushing watch band 120 and sled 1142 from a first position, as illustrated in FIG. 11, to a second position, illustrated in FIG. 12. When electrical connectors 1130 are in the electrically engaged position, pogo pins 1132 are in physical contact with respective contact portions of watch body 110, which establishes the electrical connection. Once the electrical connection has been established, data and/or power transfer can occur between watch band 120 and watch body 110.

Secondary user interaction system 1140 can further include a lock-out feature to prevent movement of watch band connector 1100 relative to watch body 110 (e.g., along first direction A1) when the electrical connection is established. For example, when secondary user interaction system 1140 is engaged, a lock-out portion 1146 of sled 1142 engages lock member 1120 and prevents the user from releasing lock member 1120 from an opening, which would otherwise permit movement of watch band connector 1100 in first direction A1. For example, lock-out portion 1146 can be inserted into a space which prevents movement of lock member 1120 when engaged by a release button. Since movement of the lock member is prevented by lock-out portion 1146, the physical connection between watch band connector 1100 and watch body 110 is maintained. Accordingly, the lock-out feature prevents the user from moving watch band connector 1100 in first direction A1—which can damage pogo pins 1132—before the electrical connection is disconnected. FIG. 11 illustrates lock-out portion 1146 in a first position, in which lock-out portion does not engage with lock member 1120. FIG. 12 illustrates lock-out portion 1146 is in a second position, in which lock-out portion 1146 is engaged with lock member 1120 and prevents movement of watch band connector 1100 (e.g., the user cannot actuate a release button). Movement of lock-out portion 1146 is dependent on the movement of sled 1142 in second direction A2, which occurs when watch band 120 and sled 1142 move toward or away from watch band connector 1100.

To disconnect the physical connection, the user must first disconnect the electrical connection, which will automatically disengage the lock-out feature. To disconnect the electrical connection the user can push a button 1150 which can release sled 1142 from a latch that snaps into place when sled is pushed in second direction A2. Once sled 1142 is released from the latch, return springs 1148 extend and push sled 1142 back to its first position, as illustrated in FIG. 11. Accordingly, lock-out portion 1146 of sled 1142 is no longer engaged with a catch member of lock member 1120, thus enabling the user to actuate release buttons of watch body 110 to disconnect the physical connection to remove watch band connector 1100 from watch body 110.

Seals 1134 can be formed around pogo pins 1132 and can hermetically seal pogo pins 1132 from external elements, such as water, air, humidity, or any other potentially detrimental environment or detritus. Seals 1134 are connected to sled 1142 by connection links 1144 (which can be rigid bars) that push seals 1134 against the slot thus creating an interference fit.

Figure 13:
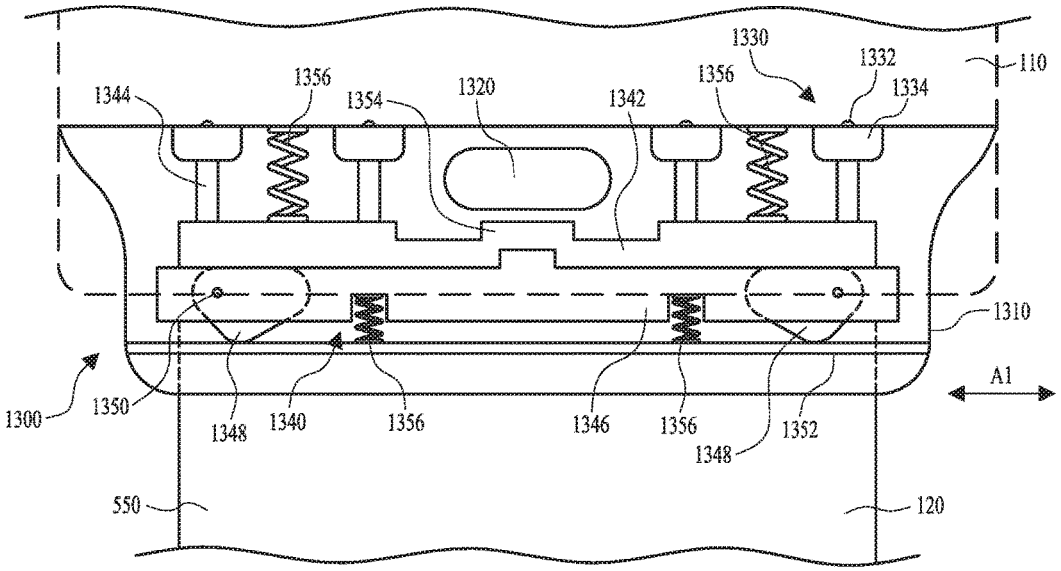
FIG. 13 shows a front schematic view of a watch body and a watch band connector in an electrically disengaged position and a secondary user interaction system in a first position.
Figure 14:
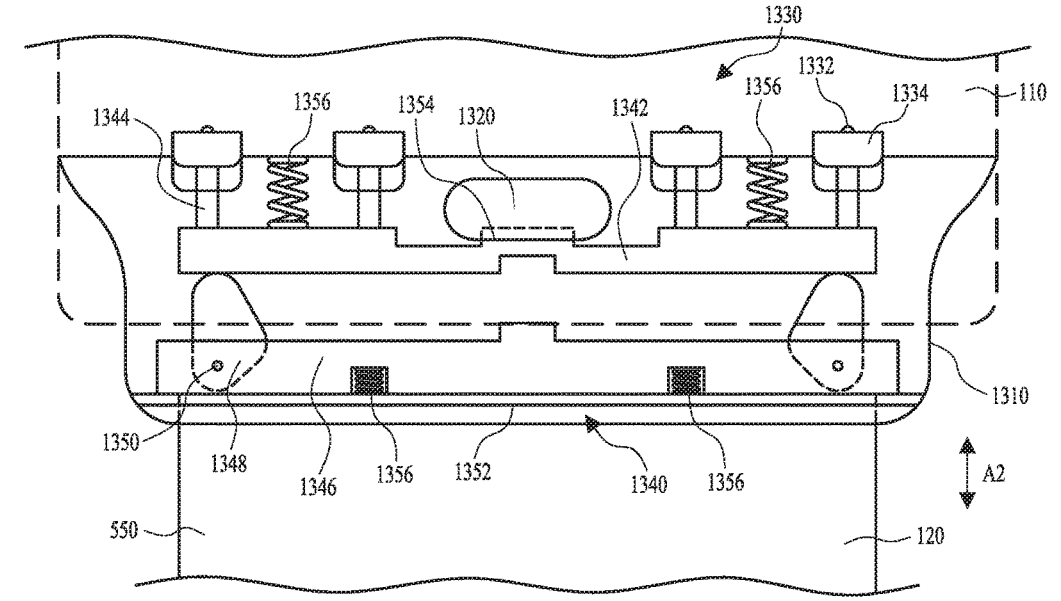
FIG. 14 shows a front schematic view of the watch body and the watch band connector of FIG. 13 in an electrically engaged position and the secondary user interaction system in a second position.

FIGS. 13 and 14 illustrate an exemplary embodiment of an electrical connection between a watch band connector 1300 and watch body 110 (illustrated in broken lines) that can be established by a secondary user interaction after the physical connection is established. Watch band connector 1200 can be integral with watch band 120 or can be a separate component coupled to strap portion 550 that forms watch band 120.

As shown in FIG. 13, watch band connector 1300 has a connector body 1310, a moveable lock member 1320, and electrical connectors 1330. Lock member 1320 can have the same features as lock member 520 described above, including a ramp that projects orthogonally from a surface of watch band connector 1300, a catch member that is flush with the opposing outer surface of watch band connector 1300, and a spring disposed between the ramp and a catch member. Each electrical connector 1330 can include a pogo pin 1332 and a seal 1334.

The user can slide watch band connector 1300 into the slot of watch body 110 along first direction A1 to physically fix watch band connector 1300 relative to watch body 110. Lock member 1320 helps secure the physical connection between watch band connector 1300 and watch body 110. When watch band connector 1300 slides in the slot, the slot pushes against the ramp of lock member 1320, which compresses the spring of lock member 1320 between the ramp and the catch member of lock member 1320. When lock member 1320 reaches a predetermined catch position within the slot, the catch member of lock member 1320 aligns with a corresponding cavity or opening of a similar shape as the catch member of lock member 1120 within the slot of watch body 110. When lock member 1320 reaches the predetermined catch position, the compressed spring extends the catch member of lock member 1320 into an opening located in the slot. Lock member 1320 fixes watch band connector 1300 relative to watch body 110, including limiting the ability of watch band connector 1300 to slide along first direction A1.

Watch band connector 1300 can further include a secondary user interaction system 1340 to establish the electrical connection after the physical connection is established. Secondary user interaction system 1340 can move pogo pins 1332 in second direction A2 to bring pogo pins 1332 into physical contact with respective contact portions.

For example, FIG. 13 illustrates secondary user interaction system 1340 involving the user pulling on watch band 120 in second direction A2 away from watch band connector 1300. Alternatively or additionally, the user can pull on strap portion 550 of watch band 120 in second direction A2 away from watch band connector 1300. Secondary user interaction system 1340 includes a sled 1342 that is disposed within watch band connector 1300. Sled 1342 can be fabricated from a rigid material and connected to electrical connectors 1130 by connection links 1144 (which can be rigid bars). Accordingly, movement of sled 1342 in second direction A2 moves electrical connectors 1130 an equal amount in the same direction. Sled 1342 is connected to a shuttle 1346 by a pair of cams 1348. Each cam 1348 can connect to shuttle 1346 at axis of rotation 1350 that allows the cam 1348 to rotate when shuttle 1346 moves in second direction A2. Cams 1348 are in contact with a ground portion 1352 of watch band connector 1300 which does not move relative to watch band connector 1300. For example, ground portion 1352 can be a rigid bar that does not move in the second direction A2 relative to watch band connector 1300, but provides a base against which cams 1348 can be forced to rotate when shuttle 1346 moves in second direction A2.

FIG. 14 illustrates electrical connectors 1330 in an electrically engaged position. Secondary user interaction system 1340 has been actuated by the user by pulling watch band 120 in second direction A2 away from watch band connector 1300, which also pulls shuttle 1346 in the same direction. As shuttle 1346 moves in second direction A2, cams 1348 rotate about axis 1350 and cams 1348 push sled 1342 oppositely in direction A2, thereby moving electrical connectors 1330 toward respective contact portions. Thus pogo pins 1332 are in moved into physical contact with contact portions to establish the electrical connection. Once the electrical connection has been established, data and/or power transfer can occur between watch band 120 and watch body 110.

Secondary user interaction system 1340 can further include a lock-out feature to prevent movement of watch band connector 1300 relative to watch body 110 (e.g., along first direction A1) when the electrical connection is established. In other words, when secondary user interaction system 1340 is engaged, a lock-out portion 1354 of sled 1342 engages lock member 1320 and prevents the user from releasing lock member 1320 from an opening, which would otherwise permit movement of watch band connector 1300 in first direction A1. For example, lock-out portion 1354 can be inserted into a space, which prevents movement of lock member 1320 when a catch member is in an opening, e.g., the user cannot actuate a release button. Since movement of the catch member is prevented by lock-out portion 1354, the physical connection between watch band connector 1300 and watch body 110 is maintained. Accordingly, the lock-out feature prevents the user from moving watch band connector 1300 in first direction A1—which can damage pogo pins 1132—before the electrical connection is disconnected. FIG. 13 illustrates lock-out portion 1354 in a first position, in which lock-out portion 1354 does not engage with lock member 1320. FIG. 14 illustrates lock-out portion 1354 is in a second position, in which lock-out portion 1354 is engaged with lock member 1320 and prevents movement of watch band connector 1300 (e.g., the user cannot actuate a release button). Movement of lock-out portion 1354 is dependent on the movement of sled 1342 in second direction A2, which occurs when watch band 120, sled 1342, and shuttle 1346 move toward or away from watch band connector 1300.

To disconnect the physical connection, the user must first disconnect the electrical connection which will automatically disengage the lock-out feature. To disconnect the electrical connection, the user can push watch band 120 toward watch band connector 1300. As the user pushes in watch band 120, shuttle 1346 and sled 1342 can return to their original positions as illustrated in FIG. 13 by return springs 1356. Accordingly, lock-out portion 1354 of sled 1342 no longer engages the catch member of lock member 1320, thus enabling the user to actuate release buttons of watch body 110 to disconnect the physical connection to remove watch band connector 1300 from watch body 110.

Seals 1334 can be formed around pogo pins 1332 and can hermetically seal pogo pins 1332 from external elements, such as water, air, humidity, or any other potentially detrimental environment or detritus. Seals 1334 are connected to sled 1342 by connection links 1344 (which can be rigid bars) that push seals 1334 against the slot thus creating an interference fit.

FIGS. 15-19 illustrate an exemplary embodiment of an electrical connection between a watch band connector 1500 and watch body 110 (illustrated in broken lines) which can be established by a secondary user interaction after the physical connection is established.

Figure 15:
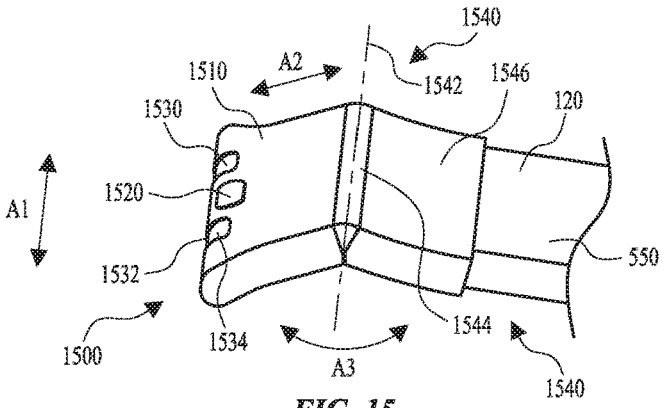
FIG. 15 shows a perspective view of a watch band connector, a watch band, and a secondary user interaction system.

FIG. 15 illustrates watch band connector 1500 with a connector body 1510, a moveable lock member 1520, and electrical connectors 1530. Lock member 1520 can have the same features as lock member 520 described above, including a ramp that projects orthogonally from a surface of watch band connector 1500, a catch member that is flush with the opposing outer surface of watch band connector 1500, and a spring disposed between the ramp and a catch member. Each electrical connector 1530 can include a pogo pin 1532 and a seal 1534. Watch band connector 1500 can be integral with watch band 120 or can be a separate component coupled to strap portion 550 that forms watch band 120.

The user can slide watch band connector 1500 into the slot of watch body 110 to physically fix watch band connector 1500 relative to watch body 110. Lock member 1520 helps secure the physical connection between watch band connector 1500 and watch body 110. When watch band connector 1500 slides in the slot, the slot pushes against the ramp of lock member 1520 and compresses the spring between the ramp and the catch member. When lock member 1520 reaches a predetermined catch position within the slot, the catch member of lock member 1520 aligns with a corresponding cavity or opening of a similar shape as the catch member within the slot of watch body 110. When lock member 1520 reaches the predetermined catch position, the compressed spring extends the catch member of lock member 1520 into an opening in the slot. Lock member 1520 fixes watch band connector 1500 relative to watch body 110 and limits the ability of watch band connector 1500 to slide along first direction A1.

Watch band connector 1500 can further include a secondary user interaction system 1540 to establish the electrical connection after the physical connection is established. Secondary user interaction system can move pogo pins 1532 in second direction A2 to engage pogo pins 1532 with respective contact portions.

Figure 16:
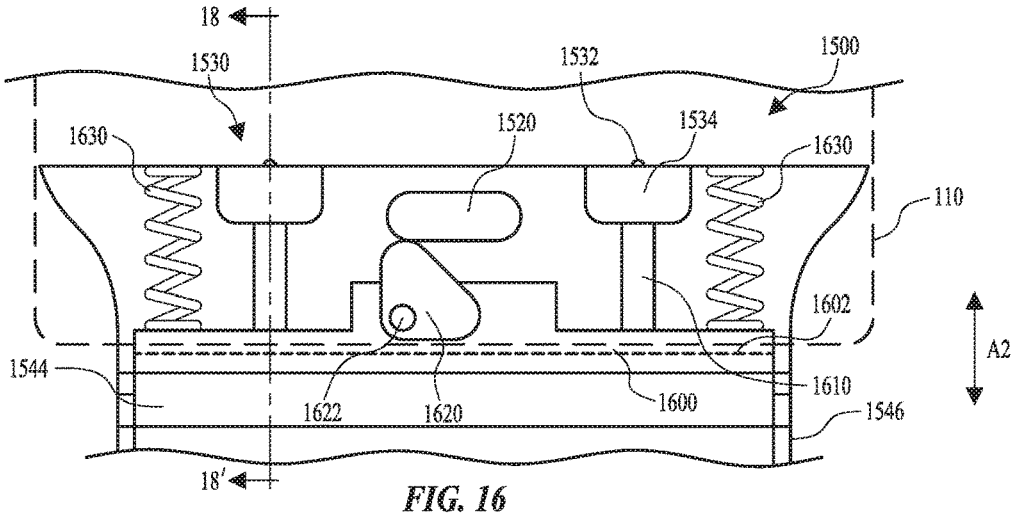
FIG. 16 shows a front schematic view of the watch body and the watch band connector of FIG. 15 in an electrically disengaged position and the secondary user interaction system in a first position.

For example, FIG. 15 illustrates secondary user interaction system involving the user rotating watch band 120 relative to watch band connector 1500 about axis 1542 (which extends in the width direction A1) as illustrated by arrow A3. Alternatively or additionally, user can rotate strap portion 550 of watch band 120 relative to watch band connector 1500. As the user rotates watch band 120 about axis 1542, a rotatable shuttle 1544 also rotates about axis 1542. Rotatable shuttle 1544 can be partially disposed within a housing 1546. Rotatable shuttle 1544 is in contact with a sled 1600, as shown in FIG. 16 and movement of rotatable shuttle 1544 causes sled 1600 to move in second direction A2. The interaction between rotatable shuttle 1544 and sled 1600 is illustrated by line 1602; however, the interaction between rotatable shuttle 1544 and sled 1600 is further explained below in regards to FIGS. 18 and 19. Sled 1600 is connected to electrical connectors 1530 by connection links 1610 (which can be rigid bars) and movement of sled 1600 in second direction A2 moves electrical connectors 1530 an equal amount in second direction A2. A cam 1620 can be connected to sled 1600 and as sled 1600 moves in second direction A2, cam 1620 can rotate about axis 1622.

Figure 17:
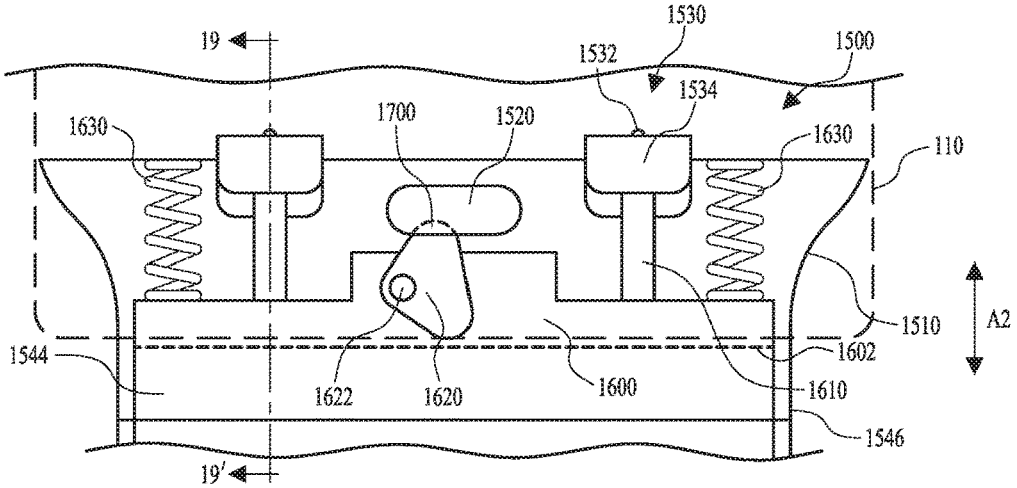
FIG. 17 shows a front schematic view of the watch body and the watch band connector of FIG. 15 in an electrically engaged position and the secondary user interaction system in a second position.

FIG. 16 illustrates electrical connectors 1530 in an electrically disengaged position in which watch band 120 can have a bent configuration, as illustrated in FIG. 15. FIG. 17 illustrates electrical connectors 1530 in an electrically engaged position, i.e., secondary user interaction system 1540 has been actuated by the user rotating watch band 120 relative to watch band connector 1500 to move sled 1600 in second direction A2. When in the electrically engaged position, watch band 120 can have a flat configuration. When electrical connectors 1530 are in the electrically engaged position, pogo pins 1532 are in physical contact with respective contact portions in the slot of watch body 110, which establishes the electrical connection. Once the electrical connection has been established, data and/or power transfer can occur between watch band 120 and watch body 110.

Secondary user interaction system 1540 can further include a lock-out feature to prevent movement of watch band connector 1500 relative to watch body 110 (e.g., along first direction A1) when the electrical connection is established. For example, when secondary user interaction system 1540 is engaged, a lock-out portion 1700 of cam 1620 engages lock member 1520 and prevents the user from releasing lock member 1520 from an opening, which would otherwise permit movement of watch band connector 1500 in first direction A1. For example, lock-out portion 1700 can be inserted into a space, which prevents movement of lock member 1520 when a catch member thereof is in an opening. Since movement of the catch member is prevented by lock-out portion 1700, the physical connection between watch band connector 1500 and watch body 110 is maintained. Accordingly, the lock-out feature prevents the user from moving watch band connector 1500 in first direction A1—which can damage pogo pins 1132—before the electrical connection is disconnected. Movement of lock-out portion 1700 is dependent on movement of sled 1600 in second direction A2, which occurs when watch band 120 rotates relative to watch band connector 1500.

To disconnect the physical connection, the user must first disconnect the electrical connection, which will automatically disengage the lock-out feature. To disconnect the electrical connection, the user can rotate watch band 120 relative to watch band connector 1500 in the opposite direction. As the user rotates watch band 120, sled 1600 can return to its original position as illustrated in FIG. 16. In some embodiments sled 1600's return to its original position can be assisted by return springs 1630. Accordingly, lock-out portion 1700 of cam 1620 no longer engages the catch member of lock member 1520, thus enabling the user to actuate release buttons of watch body 110 to disconnect the physical connection to remove watch band connector 1500.

Seals 1534 can be formed around pogo pins 1532 and can hermetically seal pogo pins 1532 from external elements, such as water, air, humidity, or any other potentially detrimental environment or detritus. Seals 1534 are connected to sled 1600 by connection links 1144 (which can be rigid bars) that push seals 1534 against the slot thus creating an inference fit.

Figure 18:
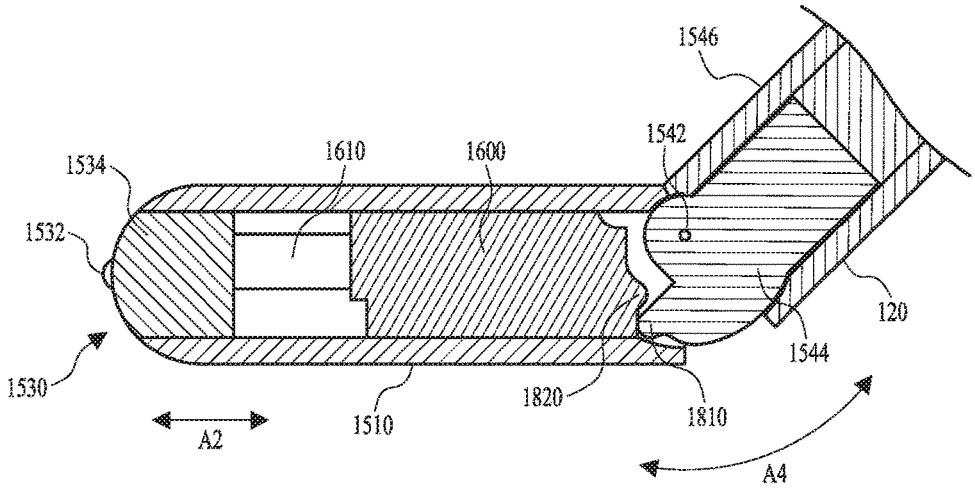
FIG. 18 shows a cross-sectional view of the watch band connector, the watch band, and the secondary user interaction system taken along line 18-18' of FIG. 16.
Figure 19:
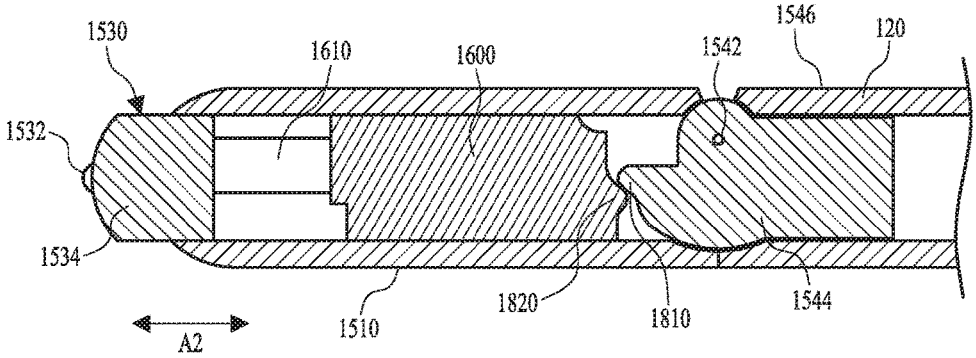
FIG. 19 shows a cross-sectional view of the watch band connector, the watch band, and the secondary user interaction system taken along line 19-19' of FIG. 17.

FIGS. 18 and 19 illustrate a cross-sectional side view of watch band connector 1500. FIG. 18 illustrates electrical connectors 1530 in an electrically disengaged position and FIG. 19 illustrates electrical connectors 1530 in the electrically engaged position. As discussed previously, secondary user interaction system 1540 includes rotatable shuttle 1544, sled 1600 and connection links 1610 connected to electrical connectors 1530. As the user rotates watch band 120 about axis 1542 in the direction of arrow A3, rotatable shuttle 1544 also rotates about axis 1542 in direction of arrow A3. Alternatively or additionally, the user can rotate strap portion 550 of watch band 120 about axis 1542 in the direction of arrow A3. Rotatable shuttle 1544 can have a projection 1810 that interacts with a projection 1820 of sled 1600. As the user rotates rotatable shuttle 1544 about axis 1542, projection 1810 slides against projection 1820 until projection 1810 passes projection 1820 and locks into place. As projection 1810 of rotatable shuttle 1800 slides against projection 1820 of sled 1600, sled 1600 is moved in direction A2 which moves pogo pins 1532 in physical contact with respective a contact portion of the slot. As discussed previously, to disconnect the electrical connection between watch body 110 and watch band connector 1500, user rotates watch band 120 the opposite direction.

Figure 20:
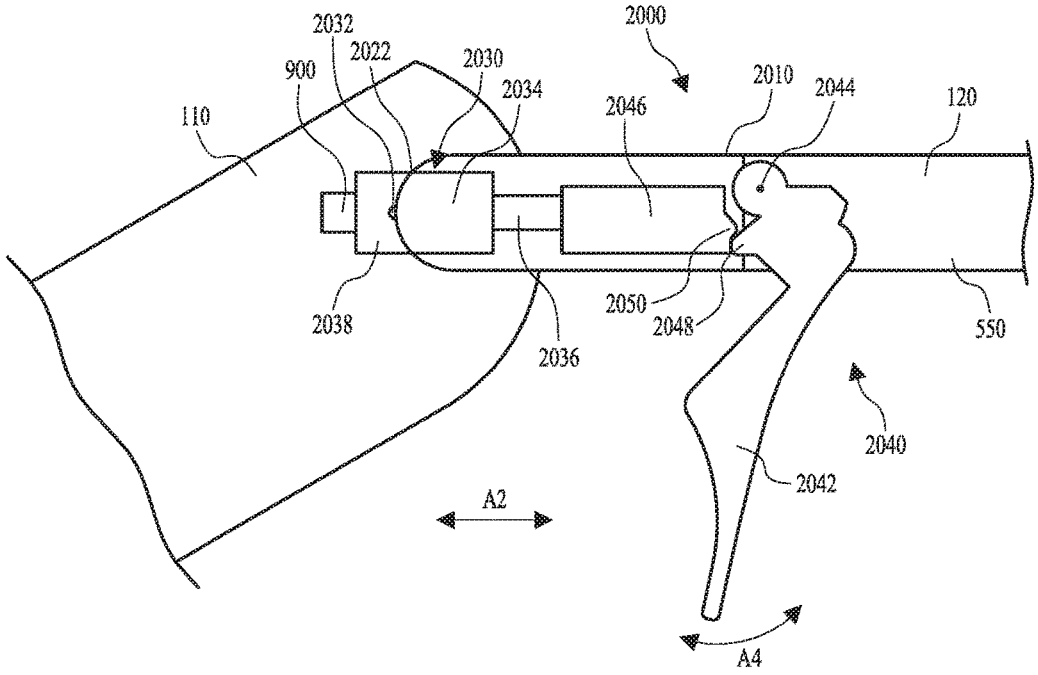
FIG. 20 shows a side schematic view of a watch body and a watch band connector in an electrically engaged position and a secondary user interaction system in a first position.
Figure 21:
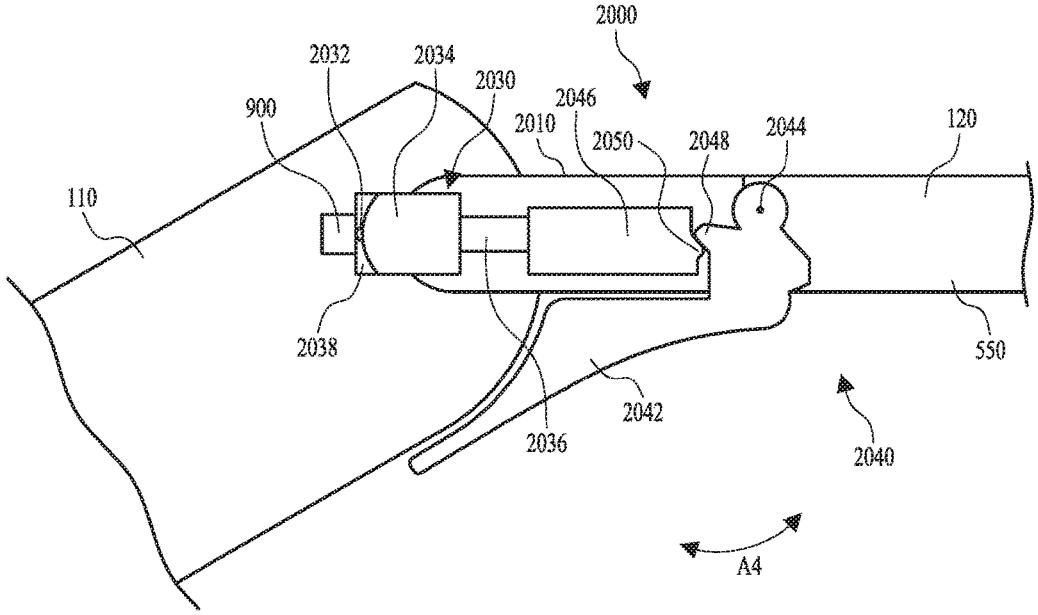
FIG. 21 shows a side schematic view of the watch body and the watch band connector of FIG. 20 in an electrically engaged position and the secondary user interaction system in a second position.

FIGS. 20 and 21 illustrate an exemplary embodiment of an electrical connection between a watch band connector 2000 and watch body 110 which can be established by a secondary user interaction after the physical connection is established.

FIG. 20 illustrates watch band connector 2000 with a connector body 2010, electrical connectors 2030, and a secondary user interaction system 2040. Electrical connectors 2030 can include pogo pins 2032, seals 2034, and connection links 2036 (which can be rigid bars) that connect to secondary user interaction system 2040. The physical connection of watch band connector 2000 is similar to watch band connector 1500, as described above. Watch band connector 2000 can be integral with watch band 120 or can be a separate component coupled to strap portion 550 that forms watch band 120. The electrical connection is established by secondary user interaction system 2040 to bring pogo pins 2032 into physical contact with respective contact portions 900 of the slot. Contact portions 900 can be retracted in channel 2038 that is connected to the slot, as illustrated in FIGS. 20 and 21.

Secondary user interaction system can involve the user rotating a flap 2042 relative to watch body 110 about an axis 2044, as illustrated by arrow A4. Flap 2042 can extend the entirety of the width of watch body 110 or alternatively the width of watch band 120. As the user rotates flap 2042 about axis 2044, a sled 2046 moves in second direction A2, as illustrated by the arrow. Sled 2046 is connected to electrical connectors 2030 by connection links 2036 (which can be rigid bars) and movement of sled 2046 in second direction A2 moves electrical connectors 2030 an equal amount in second direction A2.

FIG. 21 illustrates electrical connectors 2030 in an electrically engaged position, i.e., secondary user interaction system 2040 has been actuated by the user by rotating flap 2042 toward watch body 110 about axis 2044 to move sled 2046 in second direction A2. As the user rotates flap 2042 about axis 2044 in the direction of arrow A4, a projection 2048 of flap 2042 interacts with a projection 2050 of sled 2046. As the user rotates flap 2042 about axis 2044, projection 2048 slides against projection 2050 until projection 2048 passes projection 2050 and locks into place. As projection 2048 of flap 2042 slides against projection 2050 of sled 2046, sled 2046 is moved in direction A2, which moves pogo pins 2032 into physical contact with respective contact portions 900 of the slot. To disconnect the electrical connection between watch body 110 and watch band connector 1500, user rotates flap 2042 the opposite direction away from watch body 110.

Secondary user interaction system 2040 can further include a lock-out feature to prevent movement of watch band connector 2000 relative to watch body (e.g., along first direction A1) when the electrical connection is established. The lock-out feature for watch band connector 2000 is engaged when the user rotates flap 2042 to electrically engage the electrical connectors. When flap 2042 is rotated relative to watch body 110, flap 2042 covers release buttons which prevents the user from engaging release buttons when the electrical connection is established. To disable the lock-out feature, the user rotates flap 2042 the opposite direction, which disconnects electrical connectors 2030 and uncovers release buttons. Once the release buttons are uncovered, the user can actuate the release buttons to unlock the physical connection and remove watch band connector 2000 from the slot of watch body 110.

Figure 22:
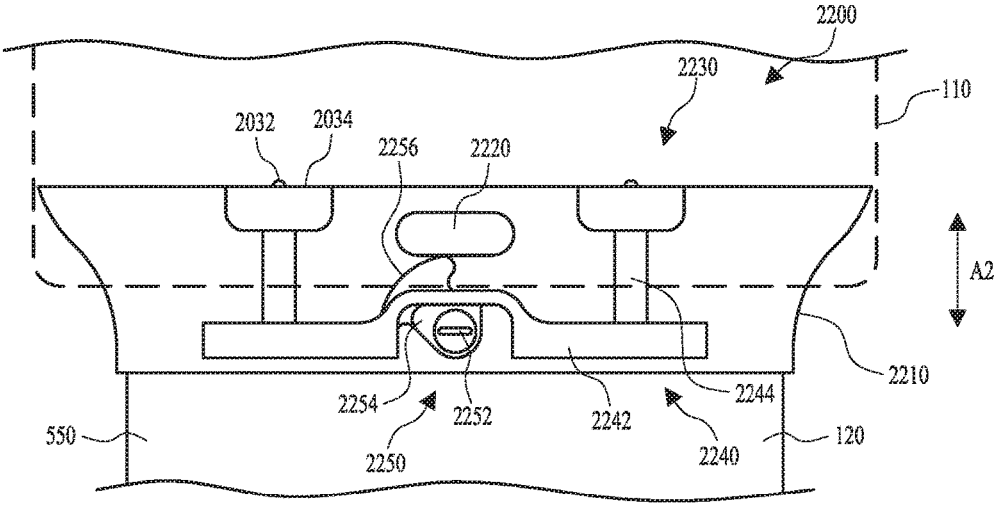
FIG. 22 shows a front schematic view of a watch body and a watch band connector in an electrically disengaged position and a secondary user interaction system in a first position.
Figure 23:
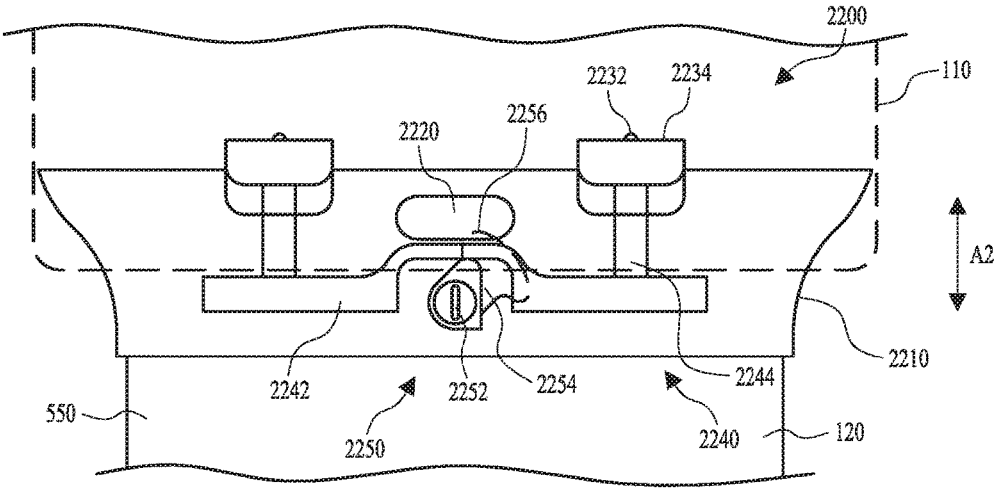
FIG. 23 shows a front schematic view of the watch body and the watch band connector of FIG. 22 in an electrically engaged position and the secondary user interaction system in a second position.

FIGS. 22 and 23 illustrate an exemplary embodiment of an electrical connection between a watch band connector 2200 and watch body 110 which can be established by a secondary user interaction after the physical connection is established.

As shown in FIG. 22, watch band connector 2200 has a connector body 2210, a movable lock member 2220, and electrical connectors 2230. Lock member 2220 can have the same features as lock member 520 described above, including a ramp that projects orthogonally from a surface of watch band connector 2200, a catch member that is flush with the opposing outer surface of watch band connector 2200, and a spring disposed between the ramp and a catch member. Each electrical connector 2230 can include a pogo pin 2232 and a seal 2234. Watch band connector 2200 can be integral with watch band 120 or can be a separate component coupled to strap portion 550 that forms watch band 120.

The user can slide watch band connector 2200 into the slot of watch body 110 to physically fix watch band connector 2200 relative to watch body 110. Lock member 2220 helps secure the physical connection between watch band connector 2200 and watch body 110. When watch band connector 2200 slides in the slot, the slot pushes against the ramp of lock member 2220 and compresses the spring of lock member 2220 between the ramp and the catch member of lock member 2220. When lock member 2220 reaches a predetermined catch position within the slot, the catch member of lock member 2220 aligns with a corresponding cavity or opening of a similar shape as the catch member within the slot of watch body 110. When lock member 2220 reaches the predetermined catch position, the compressed spring extends the catch member of lock member 2220 into an opening in the slot. Lock member 2220 fixes watch band connector 2200 relative to watch body 110, including limiting the ability of watch band connector 2200 to slide along first direction A1.

Watch band connector 2200 can further include a secondary user interaction system 2240 to establish the electrical connection after the physical connection is established. Secondary user interaction system 2240 can move pogo pins 2032 in second direction A2 to bring pogo pins 2232 into physical contact with respective contact portions in the slot.

For example, FIG. 22 illustrates secondary user interaction system 2240 involving the user rotating a cam 2250 about an axis. Cam 2250 can be within watch band connector 2200 and cam 2250 can further include an interaction interface 2252 that is exposed to the user outside of watch band connector 2200. Interaction interface 2252 can have a shape that enables a tool of a similar shape as interaction interface 2252 to interact with interaction interface 2252. Embodiments of interaction interface 2252 can take a variety of different shapes to accept a variety of different tools, such as, for example, a slot, a cross, or any other screw drive shape (e.g., Phillips, Robertson, hex, hex socket, torx, or pentalobe). The tool can be used by the user to rotate cam 2250 by inserting the tool into interaction interface 2252 and rotating interaction interface 2252 a predetermined amount, for example, a quarter turn. A portion 2254 of cam 2250 can interact with a sled 2242 as interaction interface 2252 rotates. Sled 2242 is connected to electrical connectors 2230 by connection links 2244 (which can be rigid bars). Accordingly, movement of sled 2242 in second direction A2 also moves electrical connectors 2230 an equal amount in second direction A2 to bring pogo pins 2232 into physical contact with respective contact portions in the slot. Exposed interaction interface 2252 acts as a user connection control that allows the user to control the electrical connection between watch body 110 and watch band 120.

FIG. 23 illustrates electrical connectors 2230 in an electrically engaged position, i.e., secondary user interaction system 2240 has been actuated by the user by rotating interaction interface 2252 from a first position, illustrated in FIG. 22, a quarter turn with the tool to a second position, as illustrated in FIG. 23. When electrical connectors 2230 are in an engaged position, pogo pins 2232 are in physical contact with respective contact portions 900 of watch body 110, which establishes the electrical connection. Once the electrical connection has been established, data and/or power transfer can occur between watch band 120 and watch body 110.

Secondary user interaction system 2240 can further include a lock-out feature to prevent movement of watch band connector 2200 relative to watch body (e.g., along first direction A1) when the electrical connection is established. For example, when secondary user interaction system 2240 is engaged, a lock-out portion 2256 of cam 2250 engages lock member 2220 and prevents the user from releasing lock member 2220 from an opening, which would otherwise permit movement of watch band connector 2200 in first direction A1. For example, lock-out portion 2256 can be inserted into a space, which prevents movement of lock member 2220 when actuated by a release button. Since movement of a lock member is prevented by lock-out portion 2256, the physical connection between watch band connector 2200 and watch body 110 is maintained. Accordingly, the lock-out feature prevents the user from moving watch band connector 2200 in first direction A1—which can damage pogo pins 1132—before the electrical connection is disconnected. FIG. 22 illustrates lock-out portion 2256 in a first position, in which lock-out portion 2256 does not engage with lock member 2220. FIG. 23 illustrates lock-out portion 2256 is in a second position, in which lock-out portion 2256 is engaged with lock member 2220 and prevents movement of watch band connector 2200 (e.g., the user cannot actuate the release button). Movement of lock-out portion 2256 is dependent on the rotational movement of cam 2250.

To disconnect the physical connection, the user must first disconnect the electrical connection, which will automatically disengage the lock-out feature. To disconnect the electrical connection, the user rotates interaction interface 2252 of cam 2250 a quarter turn with the tool in the opposite direction. After the user rotates cam 2250 a quarter turn, lock-out portion 2256 of cam 2250 no longer engages a catch member of lock member 2220, thus enabling the user to actuate release buttons of watch body 110 to disconnect the physical connection to remove watch band connector 2200 from the slot of watch body 110.

Seals 2234 can be formed around pogo pins 2232 and can hermetically seal pogo pins 2232 from external element, such as water, air, humidity, or any other potentially detrimental environment or detritus. Seals 2234 are connected to sled 2242 by connection links 2244 (which can be rigid bars) that push seals 2234 against the slot thus creating an interference fit.

Accordingly, the embodiments discussed herein provide locking mechanisms that facilitate engagement with longitudinal movement and disengagement with lateral and/or longitudinal movements. The engagement is therefore intuitive and comfortable for execution by a user. The engagement provides secure attachment that is controllably released with ease by a user.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A watch band comprising:

a watch band connector;

electrical connectors movable between an electrically disengaged position and an electrically engaged position; and a strap portion extending into the watch band connector and configured to move relative to the watch band connector, wherein the electrical connectors move away from the watch band connector and from the electrically disengaged position to the electrically engaged position when the strap portion is extended further into the watch band connector.

2. The watch band of claim 1, wherein the electrical connectors are moved to the electrically engaged position when the strap portion slides further into the watch band connector by a force pushing the strap portion and the watch band connector together.

3. The watch band of claim 1, wherein the electrical connectors are moved to the electrically disengaged position when the strap portion slides away from the watch band connector by a force pulling the strap portion and the watch band connector apart.

4. The watch band of claim 1, wherein the strap portion includes a rotatable shuttle, and the electrical connectors are moved to the electrically engaged position when the rotatable shuttle moves into the watch band connector by rotation of the strap portion relative to the watch band connector.

5. The watch band of claim 4, wherein the rotation of the strap portion relative to the watch band connector transitions the watch band from a bent configuration to a flat configuration.

6. The watch band of claim 4, wherein the electrical connectors are moved to the electrically disengaged position when the rotatable shuttle moves away from the watch band connector by rotation of the strap portion relative to the watch band connector, and a direction of rotation of the strap portion to disengage the electrical connectors is opposite a direction of rotation of the strap portion to engage the electrical connectors.

7. The watch band of claim 1, wherein the watch band connector includes a non-conductive portion that is configured to project from an outer surface of the watch band connector and physically connect and lock the watch band to a watch body.

8. The watch band of claim 7, wherein the strap portion is connected to a lock-out portion that moves relative to the strap portion, and extension of the strap portion further into the watch band connector moves the lock-out portion to engage with a catch member to maintain a physical connection between the watch band and the watch body.

9. A wearable device comprising:

the watch band of claim 1; and a watch body defining a slot that extends a width of the watch body, wherein the watch band is connected to the watch body via the slot.

10. A watch band comprising:

a watch band connector comprising:

electrical connectors fixed to a movable sled, wherein the electrical connectors and the movable sled are movable together between an engaged position and a disengaged position; and a shuttle connected to the movable sled by a cam; and a strap portion coupled to the shuttle, wherein movement of the strap portion away from the watch band connector rotates the cam, and rotation of the cam pushes the movable sled away from the shuttle to move the electrical connectors from the disengaged position to the engaged position.

11. The watch band of claim 10, further comprising return springs biasing the movable sled toward the disengaged position, wherein movement of the strap portion toward the watch band connector rotates the cam and the return springs push the movable sled to the disengaged position.

12. The watch band of claim 10, wherein the watch band connector includes a catch member configured to physically connect and lock the watch band to a watch body when the catch member extends into an opening of the watch body.

13. The watch band of claim 12, wherein the movable sled is connected to a lock-out portion, such that:

when the movable sled is in the engaged position, the lock-out portion maintains the catch member in the opening; and when the movable sled is moved to the disengaged position, the lock-out portion releases the catch member from the opening.

14. The watch band of claim 12, wherein the catch member is flush with an outer surface of the watch band connector.

15. A watch comprising:

a watch body;

a watch band connector connectable to the watch body, the watch band connector comprising:

a catch member configured to engage with the watch body to physically couple the watch band connector to the watch body;

electrical connectors movable between a disengaged position and an engaged position; and an interaction interface being exposed and rotatable to move the electrical connectors from the disengaged position to the engaged position.

16. The watch of claim 15, wherein the watch band connector further comprises a lock-out portion that locks the catch member to maintain a physical connection between the watch band connector and the watch body.

17. The watch of claim 16, wherein the interaction interface is a flap that is rotatable toward the watch body.

18. The watch of claim 17, wherein the lock-out portion is a portion of the flap that covers a release button of the catch member.

19. The watch of claim 15, wherein the interaction interface is rotatable by inserting and turning a tool having a shape corresponding to the interaction interface.

20. The watch of claim 19, wherein rotating the interaction interface rotates a cam that moves the electrical connectors from the disengaged position to the engaged position and engages a lock-out portion of the watch band connector.

* * * * *